US006584749B2

(12) United States Patent
Sperber

(10) Patent No.: US 6,584,749 B2
(45) Date of Patent: Jul. 1, 2003

(54) INSULATING A BUILDING USING INSULATING PARTICLES WITH FOAM AND A WEB

(76) Inventor: Henry Sperber, 8 Red Fox La., Englewood, CO (US) 80111

( * ) Notice: Subject to any disclaimer, the term of this patent is extended or adjusted under 35 U.S.C. 154(b) by 0 days.

(21) Appl. No.: 09/785,924

(22) Filed: Feb. 16, 2001

(65) Prior Publication Data

US 2002/0112442 A1 Aug. 22, 2002

(51) Int. Cl.[7] ..... E04B 2/00

(52) U.S. Cl. ..... 52/742.1; 52/404.1; 52/742.13; 52/794.1

(58) Field of Search ..... 52/742.1, 404.1, 52/404, 742.13, 742, 743, 309.8, 268, 309.9, 309.12, 309.17, 265, 269, 309.14, 794.1, 481.1, 481; 427/207.1

(56) References Cited

U.S. PATENT DOCUMENTS

| | | | | | |
|---|---|---|---|---|---|
| 2,788,552 | A | * | 4/1957 | Miles | 52/407.3 |
| 4,083,324 | A | * | 4/1978 | Krumweide | 118/300 |
| 4,712,347 | A | | 12/1987 | Sperber | 52/404 |
| 4,768,710 | A | | 9/1988 | Sperber | 239/8 |
| 4,793,113 | A | * | 12/1988 | Bodnar | 52/481.1 |
| 4,989,688 | A | * | 2/1991 | Nelson | 181/286 |
| 5,287,674 | A | * | 2/1994 | Sperber | 52/742.13 |
| 5,355,653 | A | * | 10/1994 | Henri | 52/742.13 |
| 5,365,716 | A | * | 11/1994 | Munson | 52/743 |
| 5,389,167 | A | * | 2/1995 | Sperber | 156/71 |
| 5,421,922 | A | | 6/1995 | Sperber | 156/71 |
| 5,740,643 | A | | 4/1998 | Huntley | 52/265 |
| 5,758,463 | A | * | 6/1998 | Mancini, Jr. | 52/309.12 |
| 5,819,496 | A | * | 10/1998 | Sperber | 52/742.13 |
| 6,119,422 | A | | 9/2000 | Clear et al. | 52/309.8 |

OTHER PUBLICATIONS

"House in the Round" Business Section, Stuart New Co Press Journal, Vero Beach, FL, Sunday, Mar. 1, 1998, p.D7.*
United Steel Deck, Inc., p. 12, #07410/UNI, Sweet's General Building & Renovation 1995 Catalog.*
Norfield Corp., pp. 1 –4, #07420/NOR, Sweet's General Building & Renovation 1995 Catalog.*
Fiberiffic Energy System Brochure, "The Most Advanced Insulation System in the World", Copyright 8/95.

* cited by examiner

*Primary Examiner*—Carl D. Friedman
*Assistant Examiner*—Basil Katcheves
(74) *Attorney, Agent, or Firm*—Sheridan Ross P.C.

(57) ABSTRACT

Installing insulation for a building member using a web member is provided. The web member is attached to a surface of the building member that is to be insulated. The web member has a number of spaces defined between its wire or solid elements. The insulating material is sprayed against the web member. The insulating material can include a foamable substance and insulating particles combined therewith. The insulating material is received in the spaces of the web member. The insulating material can be sprayed to pass through the thickness of the web member. The web member facilitates the holding or capturing of the insulating material.

24 Claims, 4 Drawing Sheets

INSULATING A BUILDING USING INSULATING PARTICLES WITH FOAM AND A WEB

FIELD OF THE INVENTION

The present invention relates to insulating a building and, in particular, to spraying insulation with foam against a web attached to the building.

BACKGROUND OF THE INVENTION

It is common place to insulate buildings to assist in maintaining a desired temperature within the building, e.g., to reduce the effect of outside cold temperatures on the temperature within the building. Such insulation can include a variety of insulating materials or particles, which can be provided in different forms. A cording to one well-known process for installing insulation, the insulating particles are sprayed into a cavity behind netting. In another installation process, insulating particles are combine with a foam mixture that is sprayed into a building cavity. The foam dissipates due to loss of its moisture and with the resulting structure providing spaced insulating particles to achieve the desired insulating properties.

With respect to installing insulation using this process involving foam, a building cavity can be defined using selected one or more materials including those made from wood, concrete, metal, or other applicable materials. In the case of a cavity to be insulated that is formed by a metal material, it can happen that the sprayed insulation with foam, when it contacts the metal, does not desirably or sufficiently adhere whereby the foamed insulation unwantedly moves in the cavity, such as sliding downward in a vertically-extending cavity. A key factor that might cause such an unwanted movement might be the temperature of the metal material against which the foamed insulation is sprayed. During certain environmental conditions, the metal material may be so cold that the adhesive in the sprayed foamed insulation does not adhere to the metal. Such unwanted movement can negatively affect the insulation property sought with the insulation, including its R-factor, because after the foam insulation has dried or cured, the insulation is not suitably positioned in the cavity.

It would be desirable, therefore, to avoid or at least reduce the possible unwanted movement of the insulating particles with foam having fibers when sprayed against the building material, without concern as to the temperature of the building material surface that forms the cavity and/or without concern that the surface of the building material is dirty, greasy or otherwise not conducive to holding sprayed insulating particles. Hence, it would be beneficial to be able to spray the insulation with foam even under circumstances where such building materials have a lower or colder temperature.

SUMMARY OF THE INVENTION

In accordance with the present invention, apparatus and method are disclosed to insulate a building using a web member attached to the building. The insulation material that is used to insulate the structural members of the building includes a number of insulating particles made of suitable insulation constituents, which can be selected from a large, well-known group of such insulating substances. In a preferred embodiment, the insulating particles are spread apart using an adhesive. In a more preferred embodiment, the insulating particles are spread apart using a foamable substance that includes the adhesive. The foamable substance is mixed with the insulating particles by means of appropriate or available hardware or mechanisms that receive both the foamable substance and the insulating particles. Preferably, the insulating particles are lofted or spread apart using pressurized air. Subsequently, the foamable substance is added to the lofted insulating particles. The insulating material, which can be defined as the combination of the insulating particles and the foamable substance, is output under pressure to form a spray directed to the building member to be insulated.

The apparatus also includes a web member attached to an outer surface of the building member. The web member, in a preferred embodiment, can include a commercially available mesh material or product characterized by wire-like strands that are joined together, with voids or spaces separating portions of the wire strands or other elongated relatively thin elements. In one embodiment, the web member is equivalent to the mesh material that is part of a building structure onto which a layer of stucco is overlayed. The web member must have certain properties including a sufficient strength and a suitable number of spaces or voids for receiving the insulation with foam. The web member can be in the form of a roll of material that is unrolled as it is attached to the outer surface of the building member. The web member has an inner surface adjacent to the building member and an outer surface, which is on the opposite side from the inner surface.

With respect to installing insulation, the web member is attached to the building member to be insulated, for example, by unrolling a roll of the web member in a lateral direction that covers or overlies the surface of the building member. The web member can be attached by conventional fasteners or fixtures, such as staples, stick pins, nails, screws, and the like or by using a satisfactory adhesive. After the web member is attached to the building member, the insulating material can be sprayed or otherwise supplied to the web member. The insulating material is held in place by the web member. Stated another way, the web member assists in maintaining the position of the insulating material at the location on it initially contacts or strikes, thereby avoiding unwanted movement from this sprayed position. The insulating material preferably has an uncured state and a cured state. Once sprayed against the web member, the insulating material is in an uncured state, for example, the insulating material is flowable and malleable. In the cured state, it is not flowable and is not readily malleable.

The insulating material can be sprayed with sufficient force or velocity to cause the insulating particles to pass between the outer and inner surfaces of the web member such that at least some or portions of the insulating material exits or extends from the inner surface of the web member. To achieved desired insulation, it is preferred that the majority of the insulating particles that are sprayed for a particular predetermined area or portion of the web member be disposed outwardly of its outer surface, and not a majority being located inwardly of the outer surface of the web member. In a preferred embodiment, the insulating material fills a least a majority of the voids that are part of the web member and, in a more preferred embodiment, substantially all of the voids in the web member are filled with the flowable insulating material.

Based on the foregoing summary, a number of salient features of the present invention are immediately recognized. Capturing of sprayed insulating material is facilitated using a web member attached to a building that is being insulated. Regardless of the surface temperature of the building materials, the web member acts to hold or attract the insulating material that preferably includes a foam, that is sprayed against the web member. Hence, whether the temperature of the building member is relatively high, relatively low or normal, the sprayed insulating material is held at the same, or substantially the same, location to which it was directed or sprayed. Some, a majority, or substantially all of the voids that make up the web member can be filled with insulating material, including having some of the insulating material pass through or extend from an inner surface of the web member. Such an installation of the insulating material results in desired insulation of the building including using the insulating material found in the voids of the web member. Additionally, it has been observed or determined that the web member with insulating material results in improved or desired acoustic properties by absorbing or dampening sound or sound waves. That is, in comparison with such a web member that does not have any such insulating material dispersed throughout or in its voids, there is a noticeable difference in sound absorption. For example, a web member that has its voids substantially filled with the insulating material at least doubles the sound wave absorption such that the degree, intensity or amount of sound waves that are able to pass through such a web member having insulating material in its voids is reduced by at least one-half.

Additional advantages of the present invention will become readily apparent, particularly when taken together with the following drawings.

DETAILED DESCRIPTION

An apparatus is provided that insulates a building, or sections thereof, using a web member attached thereto and insulating material sprayed against the web member. With respect to the insulating material that can include insulating particles and a foamable substance, as well as mechanisms or hardware for conducting the spraying, information and details related thereto can be obtained from U.S. Pat. No. 4,768,710 issued Sep. 6, 1988 to Henry Sperber entitled "Fibrous Blown-in Insulation Halving Homogenous Density" and U.S. Pat. No. 5,421,922 issued Jun. 6, 1995 to Henry Sperber entitled "Method for Applying a Foamed Fiber Insulation," with each of these two patents being hereby incorporated by reference in their entireties.

Figure 1:
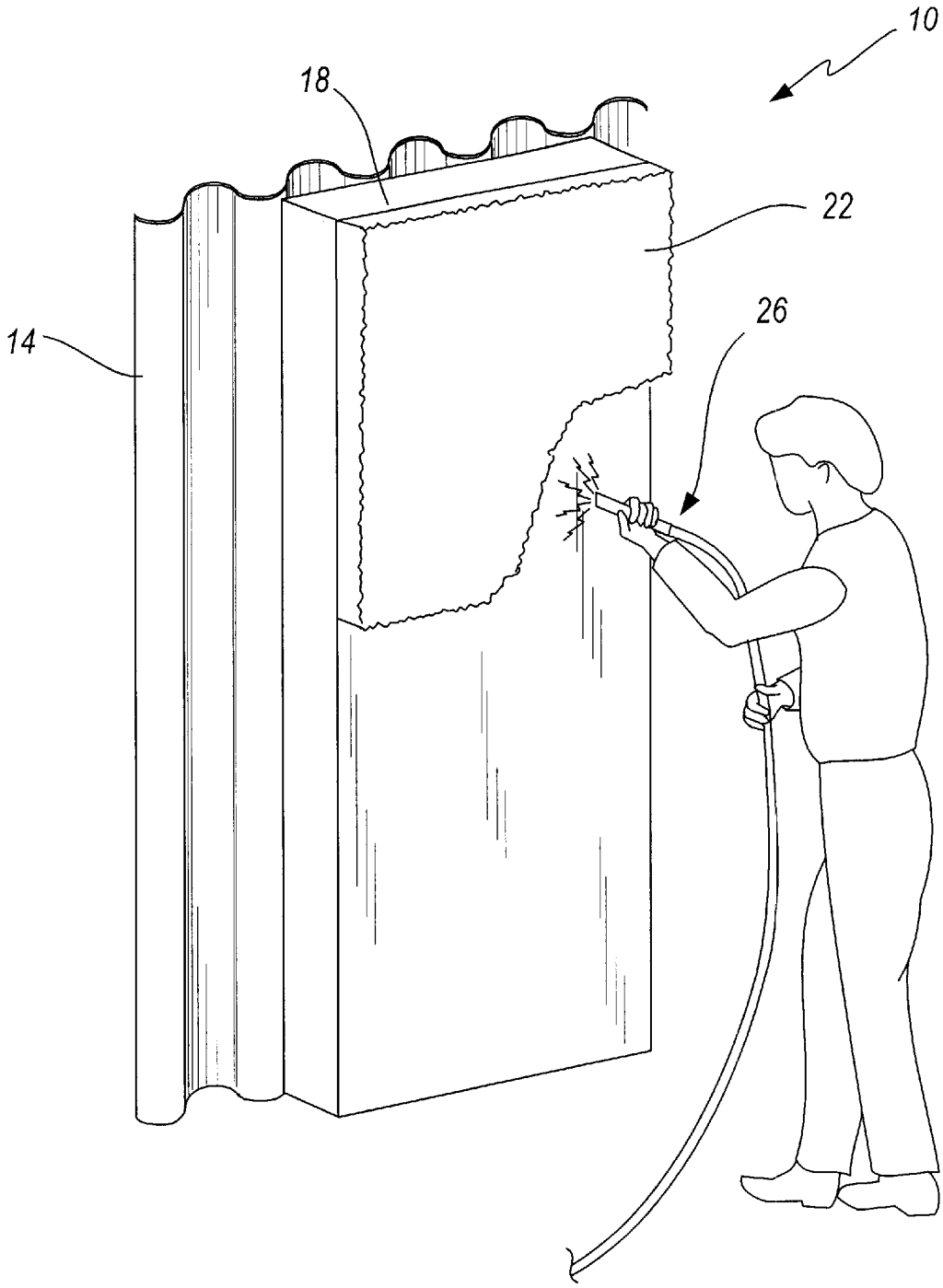
FIG. 1 is a perspective view illustrating installation of insulating particles with a foamable substance by spraying such a combination against a web member attached to an outer section of a building member.
Figure 2:
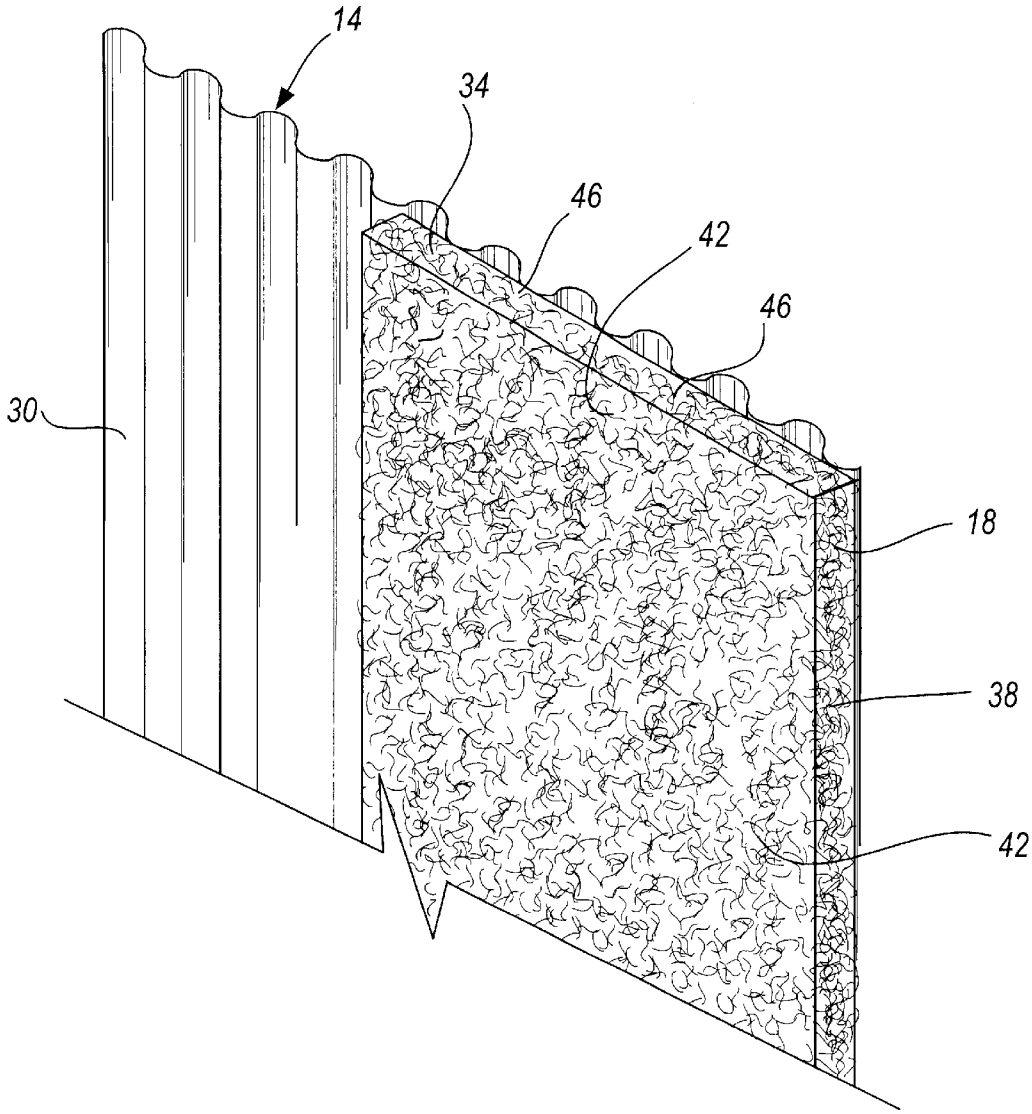
FIG. 2 is an enlarged, fragmentary, perspective view illustrating a web member attached to a section of a corrugated building member before the insulating material is sprayed there against.
Figure 3:
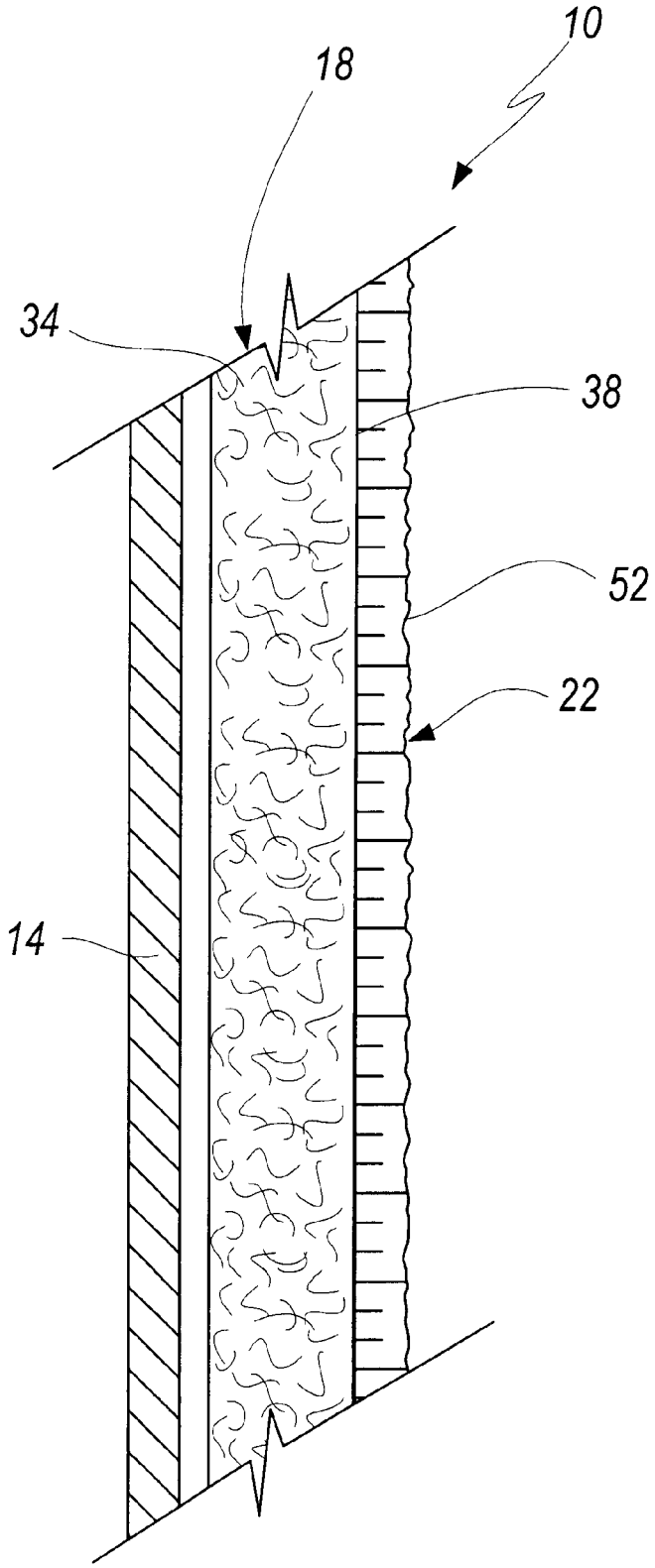
FIG. 3 is an enlarged, fragmentary longitudinal cross-sectional view of a corrugated building member to which a web member is attached and insulating material has been sprayed thereagainst.

With reference to FIGS. 1–3, a building system or apparatus 10 that is or is to be insulated is illustrated. The building apparatus 10 includes a building member 14. The building member 14 can be any building structure that is to be insulated including a wall, a floor or a ceiling. The building member 14 can be insulated on any of its surfaces including a surface facing the interior of the building or a surface facing in an outward direction relative to the building. In the embodiment illustrated in FIGS. 1–3, the building member 14 includes a section that is corrugated and, therefore, is non-planar or not flat. A building member 14, however, can be substantially planar or any other shape that is to be insulated. The building member 14 can be made of wood, metal, masonry, concrete, stucco, urethane or any other suitable building material. In accordance with the features of the present invention, although not limited thereto, it has particular utility when the building material is metal and the temperature of the metal is relatively cold, as will be discussed further later herein.

The insulated building apparatus 10 also includes a web member 18 that receives insulating material 22, which provides the desired insulation. The insulating material 22 can include insulation particles of commercially available constituents, such as rockwood, fiberglass, cellulose, wood fiber, mineral fibers, and/or recycled paper. The insulated material can also include the foamable substance, which is beneficial in suitably spreading the insulated particles relative to each other in order to achieve the desired degree of insulation. In one embodiment, the foamable substance can include a foamable adhesive material or the adhesive material may be included with a foaming agent. When the foaming agent achieve a foamed state, it acts to spread or disperse the adhesive material. The adhesive material acts to maintain the insulating particles in a desired spread positions relative to each other including after any moisture in the insulating material 22 dissipates, cures or dries. The adhesive material can be any foamable adhesive such as polyvinyl acetate, ethyl vinyl acetate, animal glues, betonite-based adhesives, plaster, and the like.

As diagrammatically illustrated in FIG. 1, in the preferred embodiment, the insulating material is sprayed using a spraying assembly 26 in order to form the insulated building apparatus 10. The spraying assembly 26 can include hardware for mixing spread or lofted insulating particles with the foamable substance. The lofted insulated particles are achieved by using pressurized air that acts to spread or separate them. While spread, the foamable substance is added in the spray assembly 26. Under sufficient pressure, the combination of the insulating particles and the foamable substance are output from the spray assembly 26 in the direction of the building member 14. Consequently, when the insulating material 22 is sprayed, there is sufficient velocity to enable the insulating material 22 to come into contact with the desired portions of the web member 18.

With reference to FIG. 2, the web member 18 is illustrated after attachment to the building member 14 but before spraying or other application of the insulating material 22. With regard to connecting the web member 18 to the building member 14, this can be accomplished using one or more of various, acceptable attachment hardware parts and procedures. For example, the web member 18 can be connected to the building member 14 by means of conventional fasteners or fixtures, such as nails, stick pins, screws, staples, as well as possibly some type of adhesive layer of sufficient binding capability to hold the web member 18 to the building member 14. The web member 18 can be in the form of a roll thereof that is unrolled as it is being attached to an outwardly extending or outer surface of the building member 14. The web member 18 can be defined as having an inner face or surface 34 that is immediately adjacent to or contacts the building member 14 and an outer face or surface 38, which is on the opposite side of the web member 18 from the innerface 34. The web member 18 has a thickness defined between the inner and outer faces 34, 38. Although not depicted in FIG. 3, the thickness of the web member 18 is usually less than the thickness of the insulating material that extends outwardly from the outer face 38.

As diagrammatically illustrated in FIGS. 2 and 3, the web member 18 is comprised of a number of connected, elongated, thin pieces or wire-like strands or similar elements, which constitute the solid portions of the web member 18. The web member 18 also has voids or spaces 46 that are defined between the wire-like elements 42.

The web member 18 is he structure that is contacted by the sprayed insulating material 22 while it is in the movable or flowable state. The sprayed insulating material contacts the web member 18 with sufficient force such that the flowable insulated material is carried past the outer face 38 into the thickness of the web member 18 to be received in the voids 46. In one embodiment, the insulating material 22 is received with sufficient force such that at least some and preferably all voids at the inner face 34 receive insulating material 22. At least some insulating material 22 can even extend past the inner surface 34 and contact the outer surface 30 of the building member 14. In the embodiment in which the building member 14 has the corrugated outer surface, some insulating material 22 can extend past the inner surface 34 to contact the bottom of the valley portions of the corrugated surface. When spraying of the insulating material 22 to a particular section of the web member 18 is finished, at least a majority of the voids 42 are filled with insulating material and, preferably, substantially all of such voids are filled with insulating material. Hence, the insulating material 22 has a thickness that extends at least from the inner face 34 to an outer surface 52 of the insulating material 22, with there being more volume of insulating material extending from the outer face 38 to the outer surface 52 than insulating material being located between inner and outer faces, 34 and 38, of the web member 18. However, for any particular area of the web member 18, the weight of the combination of the insulating material 22 therein and the web member section 18 is greater than the weight of insulating material which overlies it. Relatedly, the weight of the combination of the web member 18 and the insulating material 22 located in its voids 46 is greater than the weight of the web member 18 alone.

The web member 18 is provided to avoid unwanted movement of the flowable insulating material 22 that is sprayed thereagainst and is intended to provide insulation for the building member 14. In the absence of the web member 18, and when the building member 18 is a wall, such as illustrated in FIGS. 1–3, it can happen that the insulating material 22 upon being sprayed does not desirably or properly stay with that section of the building member 14 that received the sprayed insulating material 22. Particularly where the building member 14 is made of metal and the temperature is relatively cold and/or the building member surface is in a condition (e.g. oily, dirty) that causes the sprayed insulating material 22 not to properly hold, the sprayed insulating material 22 may not be sufficiently held by a portions of the building member 14 that come in contact with the sprayed insulating material 22. Such a result can lead to unsatisfactory or unacceptable insulating properties due to the improper location of the insulating material 22. To overcome this possibility, regardless of whether the building member 14 is made of metal or some other material, the web member 18 is able to capture and hold the insulating material so that there is little, if any, movement of the insulating material 22 from the section of building member 14 against which the sprayed insulating material 22 is directed.

The web member 18 can be a commercially available product, such as a mesh product that is useful in a building structure that includes stucco. In particular, currently available stucco mesh may be utilized. The web member 18 can be made of a variety of materials including nylon, fiberglass, plastic, and/or metal. It is desirable that the web member 18 be made of one or more materials that result in a structure having sufficient strength to hold and not change shape due to the receipt of the sprayed insulating material 22.

After insulating material 22 is sprayed against the desired sections of the web member 18, moisture in the insulating material 22 dries, including at least some of the foam thereof dissipates, so that a relatively solid insulating material 22 results. In one embodiment, other building materials can be connected outwardly of the insulating material 22. Relatedly, the outer surface 52 of the insulating material 22 can be smoothed or otherwise shaped using an appropriate tool, such as a trowel. Such shaping can be conducted regardless of whether a further building material, such as wallboard, is connected to the building apparatus 10. In addition to the insulating properties, the resulting structure of the building apparatus 10 provides soundproofing functionality. Because of the additional layer of the web ember 18 with insulating material 22 in its voids 46, the passage of sound or sound waves is further reduced over that when no such web member 18 with insulating material 22 is provided. It may be that there is at least a twofold increase or improvement in sound reduction due to the web member 18 with insulating material 22 in comparison with insulating material 22 only having the same thickness as insulating material that extends from the outer face 38 of the web member 18 to the outer surface 52 of the insulating material 22.

Figure 4:
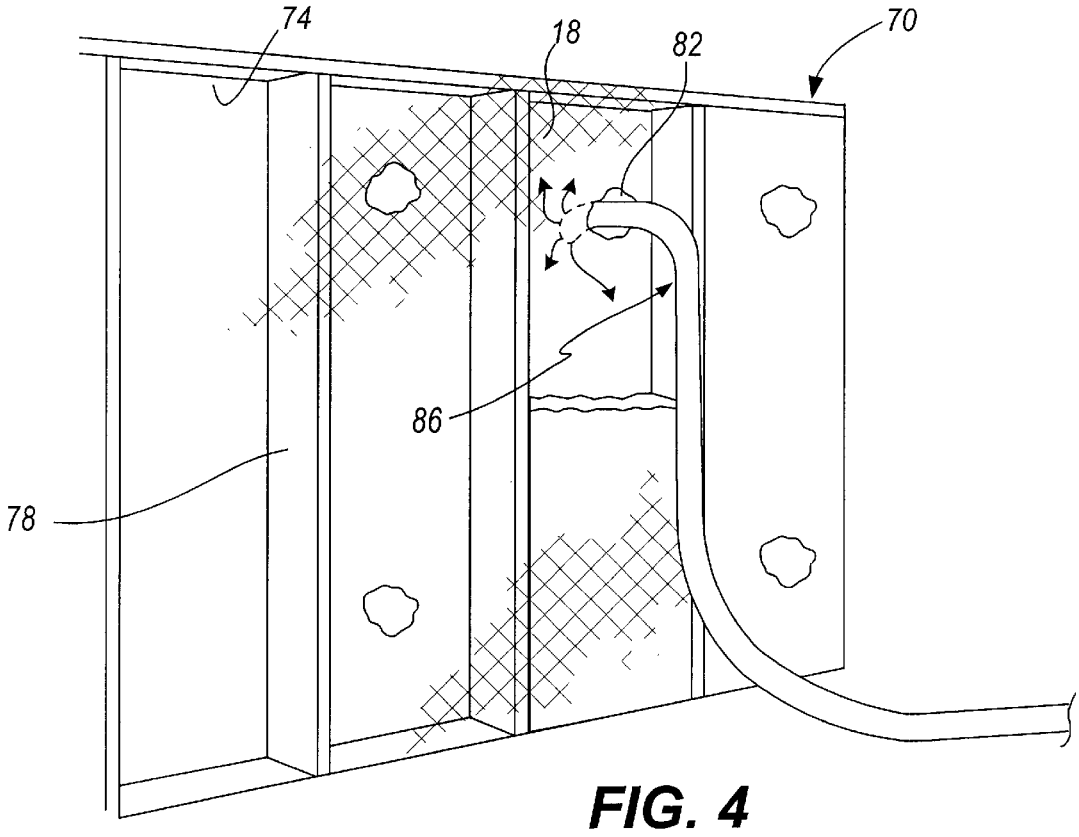
FIG. 4 is a perspective view of another embodiment in which insulating material is also provided behind a web member.

With reference to FIG. 4, another embodiment that employs the web member 18 is illustrated. In this embodiment, a building frame assembly 70 is illustrated. The building frame assembly 70 has a number of wall cavities 74 that are to receive insulating material 22. The web member 18 overlies the wall cavities 74 and is attached to the vertically-extending studs 78 of the frame assembly 70 as, for example, the web member 18 is unrolled and moved laterally relative to the frame assembly 70. Once attached to the frame assembly 70, insulating material 22 can be provided into the cavities 74 through one or more holes 82 that are formed in the web member 18. The insulating material 22 can be supplied using a hose assembly 86 having an output end, which is inserted through each of the holes 82 in the web member 18.

Figure 5:
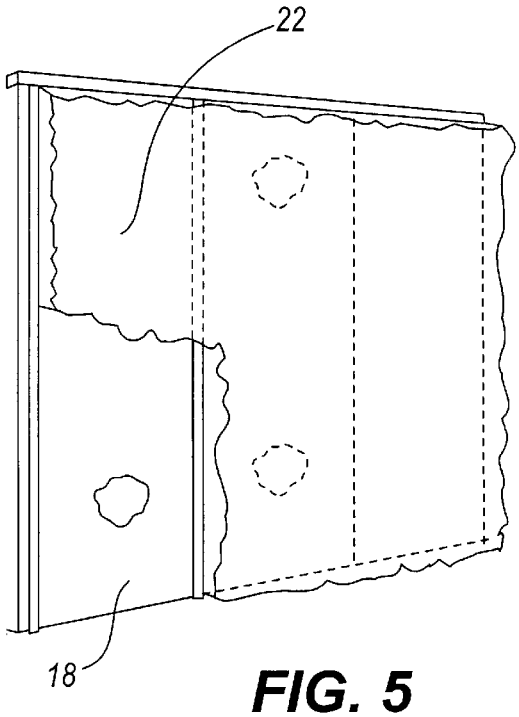
FIG. 5 is a perspective view of still another embodiment in which insulating material is provided in front of a web member and also behind the web member.

As further illustrated FIG. 5, additional insulating material 22 can be sprayed or otherwise applied to the outer surface of the web member 18. Like the preferred embodiment previously described, the web member 18 captures and holds the insulating material 22 while the spraying continues until a sufficient thickness of insulating material is located outwardly of the web member 18 and the wall cavity 74.

The foregoing discussion of the invention has been presented for purposes of illustration and description. Further, the description is not intended to limit the invention to the form disclosed herein. Consequently, variations and modifications commensurate with the above teachings, within the skill and knowledge of the relevant art, are within the scope of the present invention. The embodiments discussed hereinabove are further intended to explain the best mode known of practicing the inventions and to enable others skilled in the art to utilize the inventions in such or in other embodiments and with the various modifications required by their particular application or uses of the inventions. It is intended that the appended claims be construed to include alternative embodiments to the extent permitted by the prior art.

What is claimed is:

1. A method for insulating, comprising:

attaching a web member having a length, a width and a thickness to a building member, said web member having an inner surface adjacent to said building member and an outer surface, said thickness extending in a substantially perpendicular direction away from said building member between said inner and outer surfaces and having a number of voids defined by a number of solid portions, said thickness being substantially less than said length and being substantially less than said width, said solid portions and said voids continuously extending at least for a first extent along said web member length and also at least for a second extent along said web member width, said first extent being closer in magnitude to said length than to said thickness and said second extent being closer in magnitude to said width than to said thickness;

supplying insulating material including insulating particles to said web member while said insulating material is in an uncured state, wherein during said supplying step and when said web member is being initially contacted by said insulating material, at least some of said insulating material is received by said number of voids; and holding at least some of said insulating particles outwardly of said outer surface of said web member including after said insulating material is in a completely cured state.

2. A method, as claimed in claim 1, wherein:

a majority of said insulating particles are disposed outwardly of said outer surface of said web member.

3. A method, as claimed in claim 1, wherein:

said insulating material includes a foam substance and said supplying step includes spraying said insulating material against said web member.

4. A method, as claimed in claim 1, wherein: said number of voids includes at least a majority of voids contacted by said insulating material.

5. A method, as claimed in claim 4, wherein:

said supplying step includes allowing at least some of said insulating material to move past said inner surface of said web member.

6. A method, as claimed in claim 1, wherein:

said insulating material includes a foam substance and said cured state includes at least some moisture associated with said foam substance having been dissipated.

7. A method, as claimed in claim 1, wherein:

said number of voids includes substantially all of said voids.

8. A method, as claimed in claim 1, wherein: during said supplying, movement of said insulating material relative to said building member is substantially prevented by said web member.

9. A method, as claimed in claim 1, wherein:

said web member includes a web section and said insulating material that is held by said web section, with some of said insulating material extending outwardly of said outer surface and in which the combination of the weight of said web member section and said insulating material held said web section being greater than the weight of said insulating material located outwardly of said outer surface.

10. A method, as claimed in claim 1, wherein:

said building member includes base portions and at least first and second spaced attachment portions, said first and second attachment portions being in a plane different from said base portions and said attaching includes attaching said web member to said first and second attachment portions.

11. A method, as claimed in claim 1, wherein:

each of said first extent and said second extent is substantially greater than said web member thickness.

12. A method, as claimed in claim 1, wherein:

said outer surface terminates said thickness and at least some of said voids are located in said outer surface of said web member.

13. An insulated building apparatus, comprising:

a building member;

a web member having an inner surface adjacent to said building member and an outer surface in which a thickness of said web member is defined between said inner and outer surfaces and said outer surface terminates said thickness of said web member, said web member including solid portions and spaces between said solid portions, said web member also having a length an a width and with said thickness extending in a substantially perpendicular direction away from said building member, each of said length and said width being greater than said thickness, at least some of said spaces being located in said outer surface of said web member; and insulating material that comprises a plurality of insulating particles located in at least a majority of said web member spaces including being located in at least some web member outer surface spaces;

wherein when said insulating material initially contacts said web member, said insulating material is received by said at least a majority of said web member spaces whereby movement of said insulating material relative to the building member is substantially prevented.

14. A building apparatus, as claimed in claim 13, wherein:

said insulating material occupies at least substantially all of said web member spaces.

15. A building apparatus, as claimed in claim 13, wherein:

at least some of said insulating material extends past said inner surface of said web member.

16. A building apparatus, as claimed in claim 15, wherein:

at least some of said insulating material is disposed outwardly of said outer surface of said web member.

17. A building apparatus, as claimed in claim 16, wherein:

at least a majority of said insulating material is disposed outwardly of said outer surface of said web member.

18. A building apparatus, as claimed in claim 13, wherein:

said web member has a first weight in the absence of said insulating material and said web member has a second weight with said insulating material and with said second weight being at least 10% greater than said first weight.

19. A building apparatus, as claimed in claim 13, wherein:

said insulating material includes a foam substance and in which said insulating material has an uncured state and a cured state, with at least some moisture associated with said foam substance having dissipated after said insulating material changes from said uncured state to said cured state.

20. A building apparatus, as claimed in claim 13, wherein:

said building member includes at least one of: a wall member, a floor member and ceiling member.

21. A building apparatus, as claimed in claim 13, wherein:

said building member includes a cavity having insulation and in which said insulation, in addition to said insulating material, is provided in said cavity through at least one hole in said web member.

22. A building apparatus, as claimed in claim 13, wherein:

said insulating material sufficiently fills said spaces of said web member to reduce passage of sound between said outer surface and said inner surface of said web member.

23. An apparatus, as claimed in claim 13, wherein:

said web member has a length and a width, said solid portions and said spaces, at least in the absence of said insulating material, continuously extending at least for a first extent along said web member width and said first extent is closer in magnitude to said width than to said thickness.

24. An apparatus, as claimed in claim 13, wherein:

said building member includes base portions and at least first and second spaced attachment portions, said first and second attachment portions being in a plane different from said base portions, said inner surface being attached to said first and second attachment portions.

* * * * *